US006720511B2

(12) United States Patent
Windebank

(10) Patent No.: US 6,720,511 B2
(45) Date of Patent: Apr. 13, 2004

(54) ONE-PIECE SEMI-RIGID ELECTRICAL CONTACT

(75) Inventor: Robert Windebank, Waterbury, CT (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/234,211

(22) Filed: Sep. 5, 2002

(65) Prior Publication Data

US 2004/0045799 A1 Mar. 11, 2004

(51) Int. Cl.[7] ..... H01H 1/06
(52) U.S. Cl. ..... 200/275; 200/277; 439/66
(58) Field of Search ..... 200/275, 276, 200/276.11, 250, 277, 284, 290; 439/66, 68

(56) References Cited

U.S. PATENT DOCUMENTS 1,937,357 A * 11/1933 Otte ..... 200/254
3,032,620 A * 5/1962 Siiberg ..... 200/83 S
3,646,302 A * 2/1972 Lehmann ..... 200/299
3,781,496 A * 12/1973 Jones, Sr. ..... 200/61.45 R
4,029,375 A * 6/1977 Gabrielian ..... 439/66
4,052,580 A * 10/1977 Stanish ..... 200/535
4,156,802 A * 5/1979 Gilano et al. ..... 200/5 A
4,215,257 A * 7/1980 Repplinger ..... 200/437
4,314,121 A * 2/1982 Gaber ..... 200/433
5,051,549 A * 9/1991 Takano ..... 200/407
5,388,998 A * 2/1995 Grange et al. ..... 439/66
6,159,056 A * 12/2000 Boyle ..... 439/700
6,239,393 B1 * 5/2001 Hansen ..... 200/276
6,341,962 B1 1/2002 Sinclair
6,386,890 B1 5/2002 Bhatt et al.
6,464,511 B1 * 10/2002 Watanabe et al. ..... 439/66

* cited by examiner

*Primary Examiner*—Michael Friedhofer
*Assistant Examiner*—Lisa N Klaus
(74) *Attorney, Agent, or Firm*—Lowe Hauptman Gilman & Berner, LLP

(57) ABSTRACT

An electrical contact includes a hollow tube having first and second end portions and a center portion; and a spring portion formed in a wall of the hollow tube. The spring portion may be located in the center portion of said hollow tube or in one of the first and second end portions of the hollow tube. The spring portion may be a helical spring portion and may include two helical portions wound in opposite directions. At least one of the first and second end portions may have a diameter that is less than a diameter of said center portion. At least one of the first and second end portions may have a hemispherical shape or closed end. The hollow tube may be of a metal such as stainless steel or may be a hollow tube coated with an electrically conductive material such as one of copper, silver, or gold. The contact may have a shoulder having a diameter which is greater than the diameter of at least one of the first and second end portions and said center portion of the tube and may be disposed between one of the first and second end portions and the center portion of the tube or in one of the first and second end portions or the center portion of the tube.

34 Claims, 2 Drawing Sheets

ONE-PIECE SEMI-RIGID ELECTRICAL CONTACT

BACKGROUND OF THE INVENTION

1. Field of the Invention

The present invention relates to electrical contacts and more particularly to a one-piece semi-rigid electrical contact with an integral compression spring for use in solderless high-speed electrical connectors, that is, electrical connectors capable of operating in the frequency range of from less than 1 GHz to 20 GHz.

2. Description of the Related Art

Conventionally, an electrical connector for use with printed circuit boards, for example, contained a plurality of solder pins for soldering to the printed circuit board. While this is still used in many applications, in the case of connectors for use in high-speed applications, particularly when it is desirable to have a connector with very close pin spacing to reduce its size, it has been found that soldering such a connector to a printed circuit board becomes very costly in that it is impossible to visually locate a short or ground between the connector and the printed circuit board. An expensive x-ray technique must often be used to inspect the connections since the solder pins are hidden under the connector. Furthermore, the increasing number of pins needed in such connectors make the soldering of such connectors to printed circuit boards more difficult, thereby reducing the production yield and accordingly increasing production costs.

Still furthermore, there are presently significant uses for compact electrical connectors, capable of operating in the frequency range of from less than 1 GHz to 20 GHz, and having large numbers of coaxial or twinaxial interconnections. Conventional electrical connectors are just not suitable for such applications.

In view of the problems noted above, attempts have been made to utilize solderless electrical connectors having some form of resilient contacts used to connect the electrical connector to the printed circuit board. For example, U.S. Pat. No. 6,386,890 to Bhatt et al. discloses a printed circuit board to module mounting and interconnecting structure and method. As illustrated in FIG. 3 thereof, a resilient conductor 52 to is used to connect a contact 34 to a contact 40. The conductor 52, as noted in column 5 thereof, may be a "fuzzy button" connector similar to those produced by Cinch Inc. Alternatively, the conductor 52 may be a plated elastomeric member, a precious metal plated wire or a stamped metal contact with precious metal plating. As further noted therein, it is preferable that the precious metal wire used for the conductor 52 have a random orientation to provide multiple contact points on the contacts 40 and 34, thereby increasing the reliability of the overall electrical connection by providing multiple hertzian contacts.

Unfortunately, the resilient contacts of Bhatt et al. have proven to be somewhat fragile in that they can be easily destroyed if they brush up against a hard surface. Furthermore, they are very expensive to produce and are very difficult to install in the electrical connector, thereby increasing production costs.

On the other hand, U.S. Pat. No. 6,341,962 to Sinclair discloses a solderless grid array connector that utilizes helical wound spring contacts to make solderless connections between an electrical connector and a printed circuit board. While such spring contacts are an improvement over the resilient contacts of Bhatt et al., they are very difficult to manufacture, particularly in the case of spring contacts having very small dimensions.

Furthermore, as noted above, electrical contacts are needed for use in an electrical connector to work with high frequency pulse or analog systems, that is, for use in a frequency range of from less than 1 GHz to at least 20 GHz .The electronic properties are critical. That is, the impedance of the electrical connector requires that the capacitive reactance be controlled, the inductive reactance be controlled and the resistance value be controlled. The overall performance depends on a specific impedance Zo, (i.e., such as 50 ohms, 75 ohms, etc.) needed to maintain a minimum insertion loss and minimum reflections of the charges launched in electronic circuits, over the bandwith in use. The dimensions of the connectors are critical to ensuring a minimum of electronic disturbance and to minimize any crosstalk between adjacent channels. These electrical connectors may be used for coaxial/twinaxial and transmission line systems on motherboard to daughterboard with high-speed processors. The simple spring arrangement of Sinclair does not work at these high frequencies.

SUMMARY OF THE INVENTION

In view of the above, it is an object of the present invention to provide a one-piece semi-rigid electrical contact with an integral compression spring for use in solderless high-speed electrical connectors.

These and other objects of the present invention may be achieved by providing an electrical contact comprising: a hollow tube having first and second end portions and a center portion; and a spring portion formed in a wall of said hollow tube.

The spring portion may be a helical spring portion and may be located in one of the first and second end portions or the center portion.

The helical spring portion may include turns wound in a first direction and turns wound in a second direction opposite that of the first direction.

At least one of said first and second end portions may have a diameter that is less than a diameter of said center portion and at least one of said first and second end portions may have a hemispherical shape or a closed end.

The hollow tube may be of a metal such as stainless steel or may be a hollow tube coated with an electrically conductive material such as copper, silver, or gold.

The contact may have a shoulder having a diameter that is greater than the diameter of at least one of said first and second end portions and said center portion of the tube.

The shoulder may be disposed between one of said first and second end portions and said center portion of the tube.

The shoulder may be disposed in one of said first and second end portions of the tube or in said center portion of the tube.

These and other objects of the present invention may also be achieved by providing a method of fabricating and electrical contact, the method comprising: forming a hollow tube having first and second end portions and a center portion; and forming a spring portion in a wall of the hollow tube.

The spring portion may be formed in the center portion of the hollow tube or in one of the first and second end portions of the hollow tube.

The spring portion may be formed as a helical spring portion and the spring portion may be formed with one of a cutting process, an etching process, and a laser cutting process.

The spring portion may have turns wound in a first direction and turns wound in a second direction opposite that of the first direction.

At least one of the first and second end portions may be formed with a diameter that is less than a diameter of the center portion.

At least one of the first and second end portions may be formed so as to have a hemispherical shape.

At least one of the first and second end portions may be formed so as to have a closed end.

The hollow tube may be formed of a metal such as stainless steel.

The hollow tube may be formed of a hollow tube coated with an electrically conductive material such as one of copper, silver, or gold.

A shoulder may be formed having a diameter that is greater than the diameter of at least one of the first and second end portions and the center portion of the tube.

The shoulder may be formed between one of the first and second end portions and the center portion of the tube or in one of the first and second end portions of the tube or in the center portion of the tube.

BRIEF DESCRIPTION OF THE DRAWINGS

The foregoing and a better understanding of the present invention will become apparent from the following detailed description of an example embodiment and the claims when read in connection with the accompanying drawings, all forming a part of the disclosure of this invention. While the foregoing and following written and illustrated disclosure focuses on disclosing an example embodiment of the invention, it should be clearly understood that the same is by way of illustration and example only and that the invention is not limited thereto. This spirit and scope of the present invention are limited only by the terms of the appended claims.

DETAILED DESCRIPTION

Figure 1B:
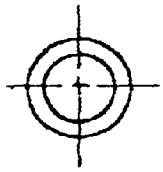
FIG. 1 is a view of one example of an embodiment of an electrical contact in accordance with the present invention.

Before beginning a detailed description of the subject invention, mention of the following is in order. When appropriate, like reference numerals and characters may be used to designate identical, corresponding, or similar components in differing drawing figures. Furthermore, in the detailed description to follow, example sizes/models/value/ranges may be given, although the present invention is not limited thereto. When specific details are set forth in order to describe example embodiment of the invention, it should be apparent to one skilled in the art that the invention can be practiced without, or with variations of, these specific details.

Figure 1A:
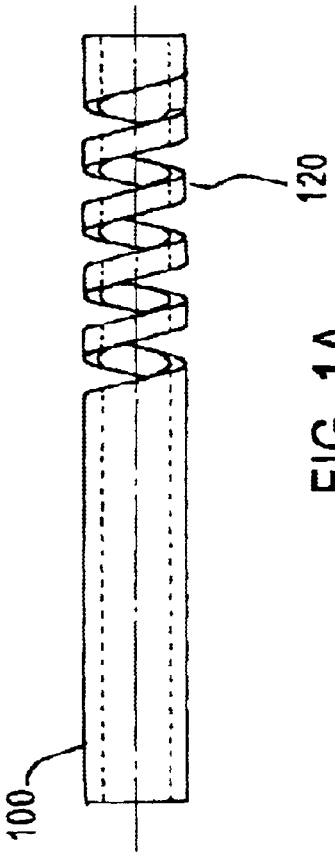

FIG. 1 is a view of one example of an embodiment of an electrical contact in accordance with the present invention. The illustrated electrical contact 100 has a tubular shape with open ends and a helical portion 120 located between the ends. As an example of the dimensions of such a contact, the length of the contact 100 may be on the order of 0.2 inches and the diameter of the contact may be on the order of 0.025 inches and the wall thickness of the contact may be on the order of 0.008 inches. Such dimensions allow the electrical contact 100 to be used in very high frequency applications in multipin surface mount electrical connectors having very close pin spacings.

There are several parameters that must be considered in designing such an electrical contact. That is, if the electrical contact is to be used in an electrical connector at a specified frequency range and impedance, it is necessary to control the capacitive reactance, and inductive reactance, and resistance value of the electrical contact. In addition, the contact spacing of the connector determines the maximum diameter of the electrical contact and the configuration of the electrical connector determines the length of the electrical contact. Furthermore, the mechanical spring force caused by the helical spring portion of the electrical contact must be specified in accordance with the requirements of the electrical connector.

To control the above-noted parameters, the length, diameter, wall thickness, length and pitch and slot width of the helical portion of the electrical contact, and material or materials used in the electrical contact can be adjusted. For example, the electrical contact 100 can be fabricated of stainless steel which may be electroplated inside and out with nickel, copper, gold, or silver to keep its electrical resistance value relatively low. Other metals may also be used for both the electrical contact and its plating material. The length and diameter of the electrical contact 100 would normally be determined by the connector configuration (that is, pin spacing and interposer thickness). The mechanical spring force and electrical reactances would determine the wall thickness, length and pitch and slot width of the helical portion of the electrical contact. The calculation of the various dimensions of the electrical contact 100 are well known to those skilled in the art and have been omitted for the sake of brevity.

The electrical contact 100 of FIG. 1 may be fabricated by first forming a tube of the desired material and diameter and wall thickness and by then cutting the tube to the proper length. If electroplating or other plating or coating techniques are needed to plate the tube with a second material, either inside or outside the tube or both inside and outside the tube, such plating can be performed before or after cutting the tube to its proper length or subsequent to further fabrication steps.

The helix portion of the electrical contact 100 would then be formed in the tube by any suitable means, such as laser cutting, or any other fine cutting or etching or similar process. The resultant electrical contact 100 would then be inserted into an aperture of an interposer of an electrical connector, such as the electrical connector disclosed in the copending U.S. patent application Ser. No. 10,234,859, entitled Interconnection System, filed concurrently with the present application and having a common Assignee.

One problem with the electrical contact 100 of FIG. 1 is the fact that its diameter is constant, such that there is nothing to prevent the electrical contact 100 from falling out of its aperture in the interposer of the electrical connector prior to its assembly. In some cases, an epoxy dot may be disposed on an outside wall of the electrical contact 100 to retain the electrical contact 100 in its aperture. Alternatively, the configuration of the electrical contact 100 can be modified so as to be as shown in FIG. 2.

Figure 2:
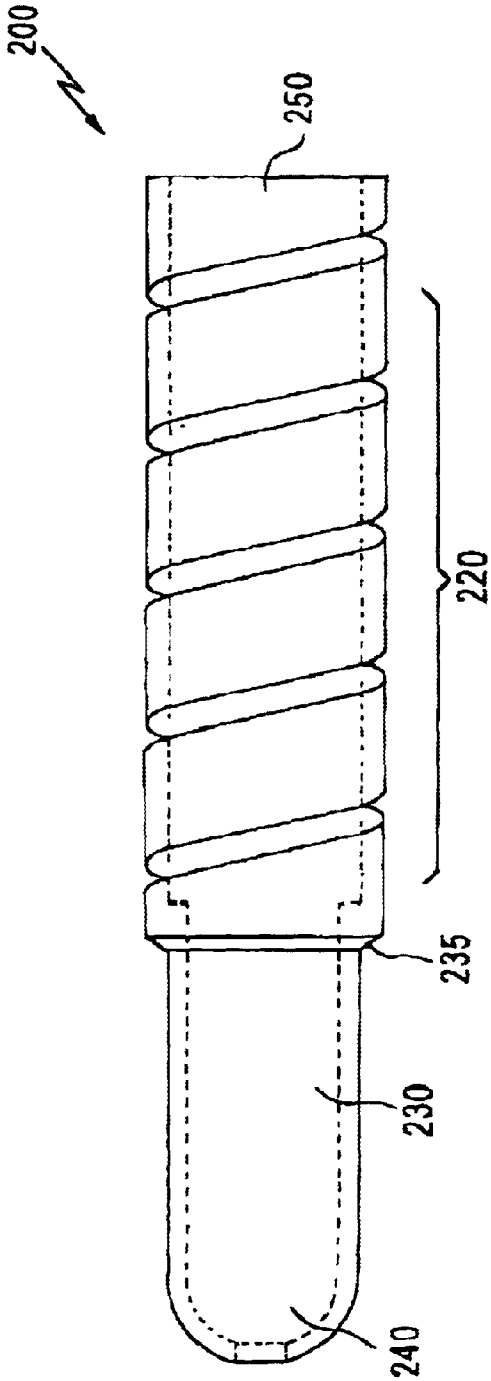
FIG. 2 is a view of another example of an embodiment of an electrical contact in accordance with the present invention.

The electrical contact 200 of FIG. 2 differs from the electrical contact 100 of FIG. 1 in several respects. Namely, the helical spring portion 220 of the electrical contact 200 is located on one end 250 thereof rather than being located in a central portion thereof. Furthermore, a reduced portion 230 of the electrical contact 200 has a reduced diameter in comparison to the helical spring portion 220, with a shoulder 235 being disposed therebetween. Still furthermore, the end portion 240 of the reduced portion 230 has been formed into a hemispherical shape. This facilitates better electrical contact with its mating contact point in certain cases. While the end portion 240 is open, it could also be formed so as to have a closed end. In addition, the end portion 240 could be formed so as to have a conical shape or so as to have a flat end. Still furthermore, the end portion 240 can be formed so as to have one or more points or serrations so as to facilitate better electrical contact with its mating contact point. It is to be noted that such an end portion 240 may be used with surface mount electrical connectors.

By forming the electrical contact 200 of FIG. 2 with the reduced portion 230, the electrical contact 200 can be prevented from falling through its respective aperture in its respective interposer by merely ensuring that the respective aperture has a diameter which is greater than that of the reduced portion 230 but less than that of the helical spring portion 220.

Figure 3B:
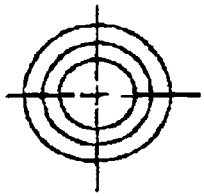
FIG. 3 is a view of yet another example of an embodiment of an electrical contact in accordance with the present invention.
Figure 3A:
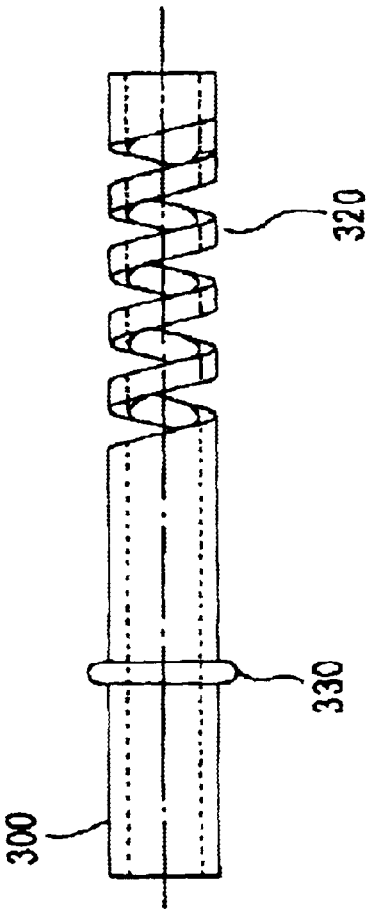

Alternatively, the configuration of the electrical contact 100 of FIG. 1 can also be modified so as to be as shown in FIG. 3. Namely, the connector 300 of FIG. 3 differs from that of the connector 100 of FIG. 1 in that a shoulder 330 has been added. The shoulder 330 has been provided to prevent the electrical contact 300 from falling through its respective aperture in its respective interposer provided that the respective aperture has a diameter which is greater than that of the helical spring portion 320 of the electrical contact 300 but less than that of the shoulder 330 of the electrical contact 300.

Figure 4B:
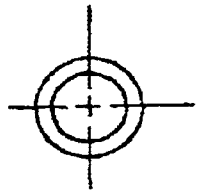
FIG. 4 is a view of still another example of an embodiment of an electrical contact in accordance with the present invention.
Figure 4A:
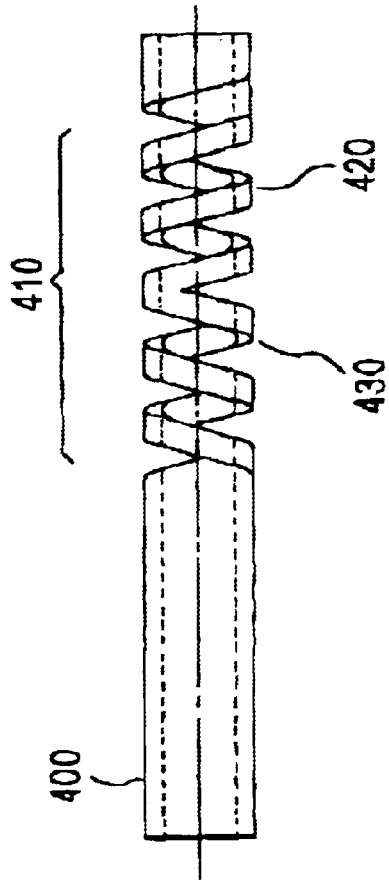

FIG. 4 is a view of still another example of an embodiment of an electrical contact in accordance with the present invention. In FIG. 4, the electrical contact 400 is similar to the electrical contact 100 of FIG. 1 with the exception of the helical portion 410 of the contact 400 being divided into two portions, namely, a first portion of 420 having turns wound in a first direction and a second portion 430 having turns wound in a second opposite direction. The use of such a helical portion 410 having turns in opposite directions results in a reduced inductive reactance for the electrical contact 400.

This concludes the description of the example embodiment. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangements within the scope of the foregoing disclosure, the drawings, and the appended claims without departing from the spirit of the invention. In additions to variations and modifications in the component parts and/or arrangements, alternative uses will also be apparent to those skilled in the art.

For example, while the illustrative examples discussed above include electrical contacts having a circular cross-section, the present invention is not limited to electrical contacts having circular cross-sections but rather includes electrical contacts having other cross-sections, such as oval cross-sections, for example. Furthermore, while the electrical contacts discussed above are indicated as being formed of metal, the present invention is not limited thereto in that there are presently available processes to coat an object formed of a non-conducting material, such as a plastic, so as to make it electrically conductive. Still furthermore, in a multi-pin connector utilizing the electrical contacts of the present invention, the winding direction of the helical spring portions of adjacent electrical contacts can be opposite each other so as to reduce any mutual inductance therebetween. Lastly, the electrical contacts of the present invention are not limited to the specific shapes illustrated in the drawing figures. That is, while a helical spring portion has been illustrated for all of the electrical contacts in the drawing figures, the present invention is not limited thereto in that shapes other than helical (such as serpentine) may be utilized in forming the spring portion of the electrical contacts.

What is claimed is:

1. An electrical contact comprising:

a hollow tube having first and second end portions and a center portion, at least one of said portions comprising a hollow rigid solid wall tube portion; and a spring portion formed as a wall of one of said portions of said hollow tube.

2. The contact of claim 1, wherein said spring portion is located in said center portion of said hollow tube.

3. The contact of claim 2, wherein said spring portion comprises a helical spring portion.

4. The contact of claim 2, wherein said spring portion comprises a helical spring portion including turns wound in a first direction and turns wound in a second direction opposite that of said first direction.

5. The contact of claim 1, wherein said spring portion is located in one of said first and second end portions of said hollow tube.

6. The contact of claim 5, wherein said spring portion comprises a helical spring portion.

7. The contact of claim 5, wherein said spring portion comprises a helical spring portion including turns wound in a first direction and turns wound in a second direction opposite that of said first direction.

8. The contact of claim 1, wherein said spring portion comprises a helical spring portion.

9. The contact of claim 1, wherein at least one of said first and second end portions has a diameter that is less than a diameter of said center portion.

10. The contact of claim 1, wherein at least one of said first and second end portions has a hemispherical shape.

11. The contact of claim 1, wherein at least one of said first and second end portions has a closed end.

12. The contact of claim 1, wherein said hollow tube comprises a metal.

13. The contact of claim 12, wherein said metal comprises stainless steel.

14. The contact of claim 1, wherein said hollow tube comprises a hollow tube coated with an electrically conductive material.

15. The contact of claim 1, wherein said hollow tube comprises a hollow tube coated with one of copper, silver, or gold.

16. The contact of claim 1, further comprising a shoulder having a diameter which is greater than a largest diameter of at least one of said first and second end portions and said center portion of said hollow tube.

17. The contact of claim 16, wherein said shoulder is disposed between one of said first and second end portions and said center portion of said hollow tube.

18. The contact of claim 16, wherein said shoulder is disposed in one of said first and second end portions of said hollow tube.

19. The contact of claim 16, wherein said shoulder is disposed in said center portion of said hollow tube.

20. The contact of claim 1, wherein said spring portion comprises a helical spring portion including turns wound in a first direction and turns wound in a second direction opposite that of said first direction.

21. An electrical contact comprising:

a hollow tube having first and second end portions and a center portion; and a spring portion formed in a wall of said hollow tube;

wherein said spring portion comprises a helical spring portion including turns wound in a first direction and turns wound in a second direction opposite that of said first direction.

22. The contact of claim 21, wherein said spring portion is located in said center portion of said hollow tube.

23. The contact of claim 21, wherein said spring portion is located in one of said first and second end portions of said hollow tube.

24. The contact of claim 21, wherein at least one of said first and second end portions has a diameter that is less than a diameter of said center portion.

25. The contact of claim 21, wherein at least one of said first and second end portions has a hemispherical shape.

26. The contact of claim 21, wherein at least one of said first and second end portions has a closed end.

27. The contact of claim 21, wherein said hollow tube comprises a metal.

28. The contact of claim 27, wherein said metal comprises stainless steel.

29. The contact of claim 21, wherein said hollow tube comprises a hollow tube coated with an electrically conductive material.

30. The contact of claim 21, wherein said hollow tube comprises a hollow tube coated with one of copper, silver, or gold.

31. The contact of claim 21, further comprising a shoulder having a diameter which is greater than a largest diameter of at least one of said first and second end portions and said center portion of said hollow tube.

32. The contact of claim 31, wherein said shoulder is disposed between one of said first and second end portions and said center portion of said hollow tube.

33. The contact of claim 31, wherein said shoulder is disposed in one of said first and second end portions of said hollow tube.

34. The contact of claim 31, wherein said shoulder is disposed in said center portion of said hollow tube.

* * * * *